United States Patent [19]

Goodwin

[11] Patent Number: 4,879,777

[45] **Date of Patent: * Nov. 14, 1989**

[54] FLUIDIZED PATIENT SUPPORT SYSTEM

[75] Inventor: Vernon L. Goodwin, Charlotte, N.C.

[73] Assignee: Support Systems International, Inc., Charleston, S.C.

[ * ] Notice: The portion of the term of this patent subsequent to Oct. 11, 2005 has been disclaimed.

[21] Appl. No.: 204,204

[22] Filed: Jun. 8, 1988

Related U.S. Application Data

[60] Continuation of Ser. No. 62,176, Jun. 12, 1987, Pat. No. 4,776,050, which is a continuation of Ser. No. 796,780, Nov. 12, 1985, Pat. No. 4,672,699, which is a division of Ser. No. 571,557, Jan. 17, 1984, Pat. No. 4,564,965.

[51] Int. Cl.[4] ..... A47C 27/08; A47C 31/02

[52] U.S. Cl. ..... 5/453; 5/406; 24/462; 160/395

[58] Field of Search ..... 5/453, 469, 423, 449, 5/403–407, 430; 128/33, 38; 24/462; 162/392, 395

[56] References Cited

U.S. PATENT DOCUMENTS

| | | | |
|---|---|---|---|
| 2,709,489 | 5/1955 | Keebler | 160/395 |
| 2,760,559 | 8/1956 | Austin | 5/407 |
| 3,069,700 | 12/1962 | Berlin | 5/430 |
| 3,197,789 | 8/1965 | Ashkovti et al. | 5/403 |
| 3,354,476 | 11/1967 | Scales et al. | 5/453 |
| 3,971,083 | 7/1976 | Peterson | 5/430 |
| 4,214,576 | 7/1980 | Henley | 128/38 |
| 4,233,790 | 11/1980 | Meadows | 160/395 |
| 4,483,029 | 11/1984 | Paul | 5/453 |
| 4,498,205 | 2/1985 | Hino | 5/453 |

FOREIGN PATENT DOCUMENTS

| | | | |
|---|---|---|---|
| 1037236 | 7/1966 | United Kingdom | 160/392 |
| 1165725 | 10/1969 | United Kingdom | 160/395 |

*Primary Examiner*—Alexander Grosz

*Attorney, Agent, or Firm*—Dority & Manning

[57] ABSTRACT

An improved fluidizable patient support system including an oval tank, a perforated plate received in the tank atop a plurality of spacers, a diffuser board located atop the perforated plate and sealed around its edge, a mass of granular material received atop the diffuser board, a flexible sheet removably secured around upper edges of the tank by snap fitting elements, a wheeled support pedestal for the tank which has a fluid pressure generator therewithin. Pivotal steps and side rails may be associated with the pedestal and tank respectively. A support frame may also be secured to the tank, extending thereabove to receive treatment apparatus.

4 Claims, 9 Drawing Sheets

FLUIDIZED PATIENT SUPPORT SYSTEM

This is a continuation of application Ser. No. 062,176, filed June 12, 1987, now U.S. Pat. No. 4,776,050, which is a continuation of Ser. No. 796,780, filed Nov. 12, 1985, now U.S. Pat. No. 4,672,699, which is a division of application Ser. No. 571,557, filed June 17, 1984, now U.S. Pat. No. 4,564,965.

BACKGROUND OF THE INVENTION

This invention relates to an improved fluidized patient support system that is of particular advantage to burn patients, as well as other patients who are immobilized for extended recuperative periods.

Historically, hospital beds for patients have in general been conventional where, though adjustable as to height and attitude, a mattress-springs arrangement has been provided for receiving the patient thereon covered, of course, with appropriate bed clothing. Particular problems have developed in use of the conventional hospital beds where the patients, due to prolonged contact with the support surface in generally immobile condition, have developed decubitus ulcers or bed sores, as a result of pressure points produced between the support surface and certain portions of the patient's body. Additionally, in the case of burn patients where the severity of the injury or wound is such that the patient is affected over a significant portion of his body, conventional beds present problems not only with the healing process due to contact between raw areas of the human body and the support, but also due to fluids exuding from the patient's body. In like fashion, other types of injuries and reasons for confinement have presented problems with the conventional hospital bed.

In order to obviate some of the problems inherent with the conventional hospital bed, fluidized patient support structures have been developed as exemplified in the Hargest et al. U.S. Pat. No. 3,428,973, in which a tank is provided, partially filled with a mass of granular material which is received atop a diffuser surface and is covered with a loose fitting flexible patient contact sheet or surface. Fluid, such as air, is forced through the diffuser and fluidizes the granular material, preferably ceramic spheres, with adequate force that a patient received on the flexible sheet is suspended on the fluidized bed. In this fashion, very gentle forces are imparted to the body portions of the patient, whereby the incidence of development of decubitus ulcers is reduced and whereby an individual experiencing trauma, such as produced by severe burns may rest comfortably. In similar fashion, a further fluidized patient support structure is disclosed in the Hargest U.S. Pat. No. 3,866,606 which structure has the same basic elements of that mentioned above with the addition of control means to cyclicly fluidize the granular material, also preferably ceramic spheres, for flotation of the patient, whereby in a non-fluidized state, the patient settles into the mass of granular material which becomes a rigid body contoured structure against which the patient's body may be placed in traction. In like fashion, the cyclic effect of fluidizing-rigidifying the mass of granular material permits variation in patient attitude, again towards the reduction of the incidence of development of decubitus ulcers.

While the two fluidized support structures described above are successful for their intended purpose, the present invention represents improvement thereover.

Particularly the present invention represents improved structural and operational features leading to improved mobility, less weight, more compactness to the unit and the like.

SUMMARY OF THE INVENTION

It is an object of the present invention to provide an improved fluidized patient support system.

Yet another object of the present invention is to provide a fluidized patient support system that is flexible in design characteristics, is light, relatively inexpensive, and easy to maintain free of contamination.

Still further, another object of the present invention is to provide an improved fluidized patient support system, which is more compact and more mobile than prior art structures.

Still another object of the present invention is to provide an improved diffuser arrangement for fluidization of the granular materials.

Another object of the present invention is to provide an improved means for securement of the flexible sheet material to the tanks.

Yet another object of the present invention is to provide a patient support system that permits improved patient treatment therein.

Generally speaking the improved patient support system of the present invention comprises an open ended container means having a bottom wall and side walls; support means for said container means; a perforated support plate received within said container means; a plurality of spacer means received within said container means and being located between said bottom wall and said perforated plate, said spacer means defining a threaded opening therein, the space between said perforated plate and said bottom wall defining a plenum chamber; a fluid diffuser means received atop said perforated plate, said diffuser means being pervious to passage of fluid therethrough, said diffuser means, porous plate, spacers, and bottom wall being associated; sealing means received about said diffuser means around outer edges of same; a mass of granular material received within said container means atop said diffuser means; flexible sheet means removably secured around said container means and loosely residing atop said granular material when said granular material is in a nonfluidized state and being raiseable when said granular material is in a fluidized state, said flexible sheet being pervious to fluid and impervious to passage of said granular material, and means for generating adequate fluid pressure in said plenum chamber that fluid passes through said diffuser means and fluidizes said granular material beneath said sheet means adequate to support a patient thereon.

In one preferred embodiment, the improved patient support system according to teachings of the present invention comprises an open end container means that is oval in shape and which is supported by a pedestal in which controls, fluid pressure generating means and the like are received, and on which foldable steps or the like are mounted. Unique side rails may also be secured to the sides of the oval container. The bottom wall of the container is provided with a plurality of openings for securement of a perforated plate and diffuser board thereto. Likewise, a frame structure is secureable to an underside of the container and to sidewalls of same, extending upwardly above the container to receive necessary medical apparatus for use in treatment of a patient. Preferably, the diffuser board, perforated plate, spacers for the plate, and frame structure are secured to the container bottom wall. A mass of granular material, preferably ceramic spheres, is received within said container atop the diffuser board. A flexible sheet is received thereover and removeably secured at upper edges of the container sidewalls completely therearound by way of a flexible rim cover that snap fits into an upper portion of the side wall with an edge of the sheet received therebetween. The flexible sheet is loosely received atop the granular material, and once the granular material is fluidized the sheet material moves upwardly in balloon fashion. A patient lying on the sheet material is supported by the fluidized material without the introduction of pressure points on the patient's body.

More specifically, the fluidized patient support system of the present invention comprises an oval tank having an open end into which a similarly shaped perforated support plate is placed, the plate having a plurality of openings therein that effect the porosity of same. Also, a number of the holes are spaced in a predetermined fashion to correspond to like positioned holes in the bottom wall of the tank. Spacer means are provided between the bottom wall and the porous plate. In one embodiment, the spacers are adapted to partially reside within the holes in the tank wall at one end and the plate at the other end with an enlarged medial section unit supports the plate above the bottom wall to define the plenum chamber. Each spacer defines a central opening therethrough that is threaded at least at opposite outer ends. The diffuser board, which preferably has hydrophobic characteristics, rests atop the perforated plate and is likewise provided with a plurality of holes that correspond positionally to the holes in the support plate. Bolts or other connectors may thus be provided from one or opposite ends of the spacer means to unify the plate and diffuser board to the tank. A mass of granular material, preferably ceramic spheres, is loaded into the tank, atop the diffuser board with the flexible sheet located thereabove. Fluid pressure generator means are provided to introduce a pressurized fluid into the plenum chamber, which diffuses through the diffuser board, and depending upon the pressure of same, flow of same and porosity of the diffuser board, fluidizes the granular material to a predetermined height. The fluid, preferably air, may be heated or otherwise pre-treated for therapeutic value or patient comfort.

The flexible sheet means that is received atop the tank should not be taut and is preferably removably secured to a contoured rim located atop sidewalls of the tank by a snap fitting, contoured cap. While the sheet is held with adequate force that the weight of the patient will not pull same from within the contoured rim, the snap cap may be easily disengaged from the rim for removal of the sheet for cleaning, replacement or the like.

DESCRIPTION OF THE PREFERRED EMBODIMENTS

Figure 1:
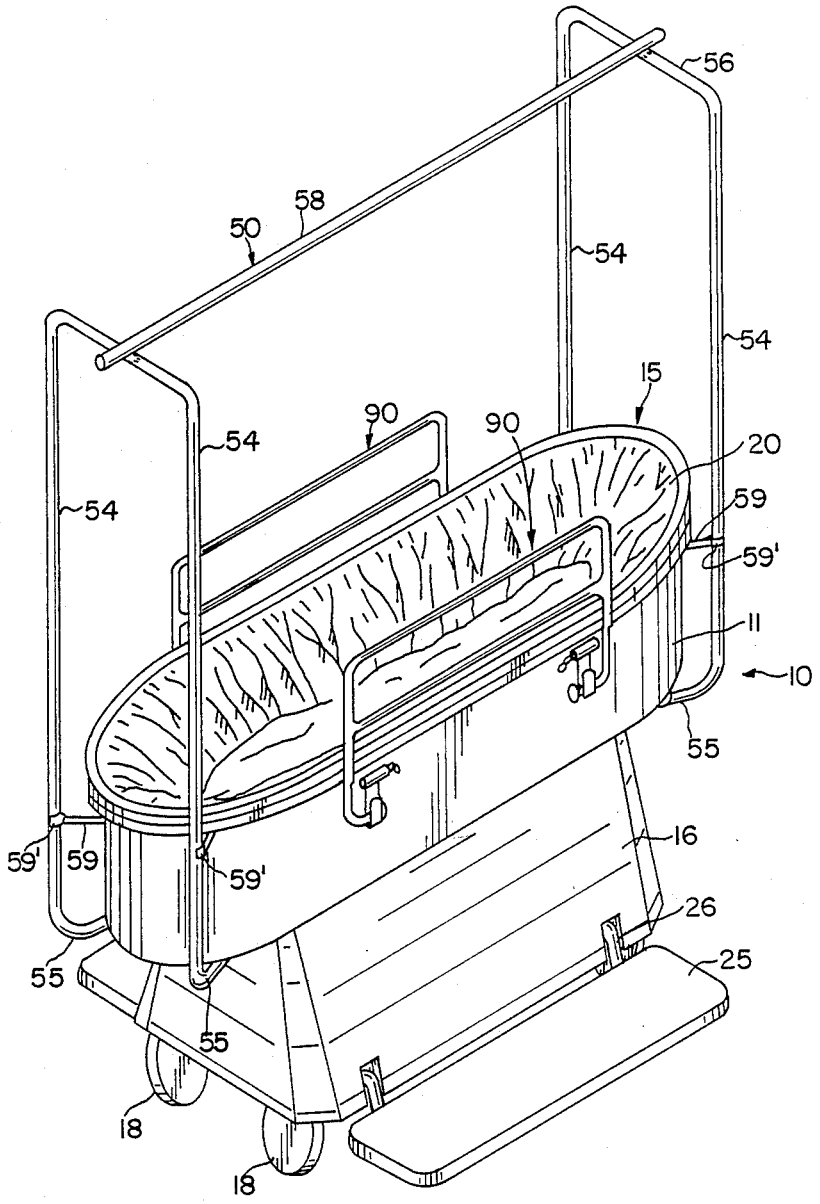
FIG. 1 is an isometric view of an improved patient support system according to the present invention.
Figure 2:
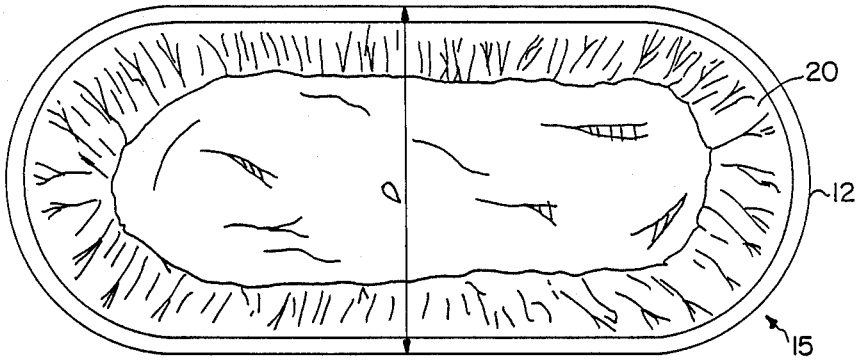
FIG. 2 is a top plan view of a tank for patient support system according to the present invention.

Making reference to the Figures, preferred embodiments of the present invention will now be described in detail. In FIGS. 1 through 5, a patient support structure according to teachings of the present invention, is shown wherein the structure generally indicated as 10 includes an open ended tank generally 15 that is defined by vertical side walls 11 that generally define an oval shape and a corresponding shaped bottom wall 13. Tank 15 is supported by a pedestal 16 which may be provided with wheels or other rollable supports 18. A flexible sheet material 20 is received within tank 15 and is supported by a fluidized bed of granular material 60 (see FIG. 5) and on which a patient directly resides, or when non-fluidized, the granular material itself (see FIG. 1). A patient lying atop sheet 20 will generally settle to a certain depth within the fluidized bed of granular material, with flexible sheet 20 conforming to the patient's body due to the fact that in those immediately adjacent areas where body contact is not made, the fluidized bed extends to a higher elevation than beneath the body of the patient. As such the patient is less prone to develop decubitus ulcers during prolonged periods of confinement, and in general experiences more comfort than in a conventional bed.

Tank 15 by virtue of its oval shape both reduces the quantity of ceramic spheres necessary for providing the fluidized support and affords a more maneuverable system. Though prior art structures have included wheel support, the devices have not been truly mobile, and in fact, certain of the prior devices have utilized spring arrangements in conjunction with wheels which were compressed when granular materials were placed into the container and rendered the wheels inoperative. Overall weight and physical dimensions of support structure 10 are thus quite important if a truly mobile unit is contemplated. Structures according to the present invention may be manufactured in a truly mobile mode as indicated by the rollers or wheels 18 located beneath the tank even in the presence of the granular material. In this fashion, the structure is portable, may be rolled from one location to another, such as from a patient's room to an operative suite where a patient may be transferred from an operating table directly to the fluidized support structure and returned to the patient's room. Since mobility of system 10 is important, the dimensions and shape of same are likewise important to permit ready maneuvering and passage of system through doorways around other furniture and equipment and the like. Accordingly, system 10 has been so designed that all appurtenances to same remain within a maximum width of tank 15 as will be further discussed hereinafter.

While the tank or container 15 may be manufactured of any suitable material that will adequately support the patient and the weight of the system 10, lightweight structural materials, such as aluminum, reinforced fiberglass sheets, foamed core polymeric sheets, or the like may be utilized to further reduce weight of the overall structure.

Pedestal 16 as illustrated in the Figures is generally rectangular in overall shape, and as described in more detail hereinafter is secured to an underside of tank 15. Pedestal 16 preferably houses all systems and controls for operations of system 10, such as a fluid pressure generating means 62 and fluid conditioning means 64 illustrated in phantom in FIG. 5. Such suitable systems and controls are also generally set forth in the aforesaid U.S. patents to Hargest et al. and Hargest the description of which is incorporated by reference herein. The systems and controls, per se for fluid handling do not, however, represent novel features of the present invention. Generally such controls include air pumping means, a fluid heat exchanger and the guages, switches, etc for use in monitoring an operation of the same.

Figure 3:
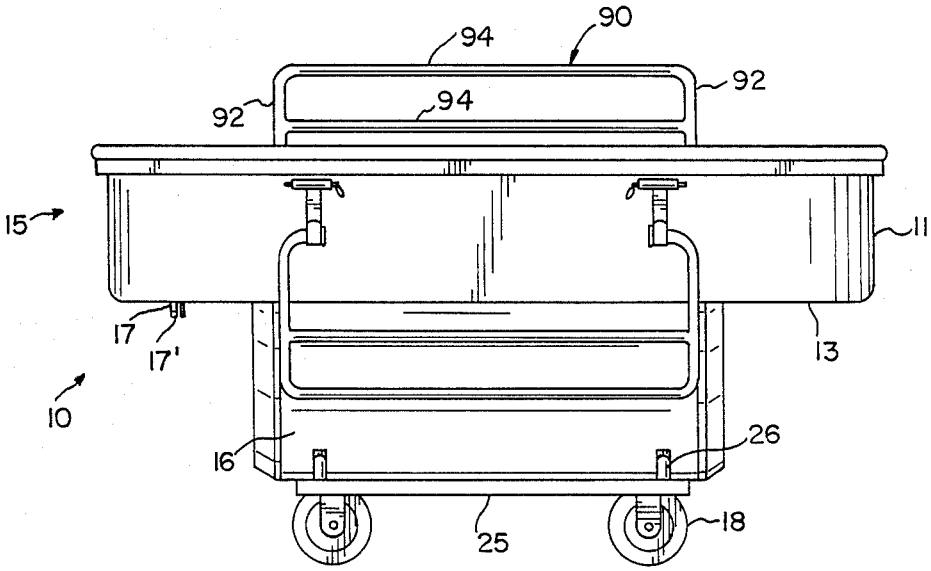
FIG. 3 is a side elevational view of a patient support system according to the present invention shown without an upper support frame.
Figure 4:
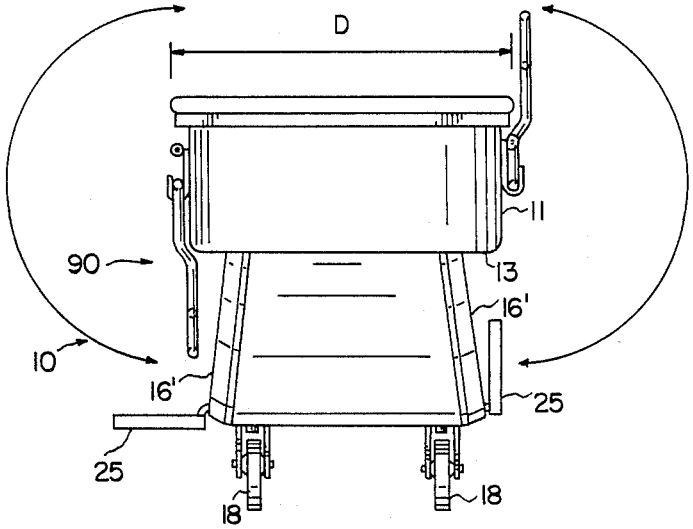
FIG. 4 is an end elevational view of the patient support system as shown in FIG. 3.
Figure 17:
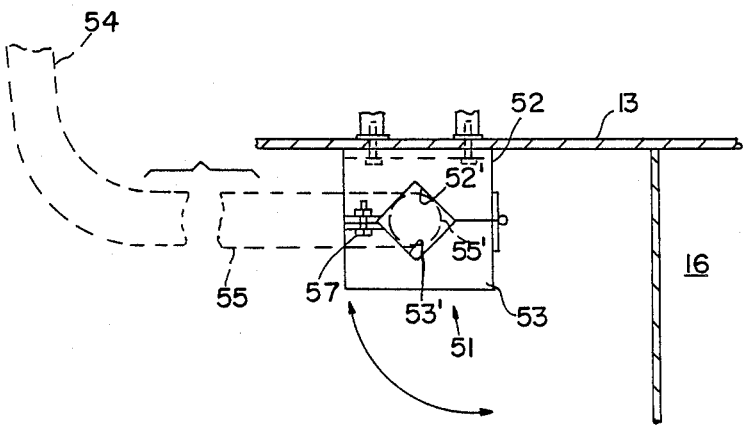
FIG. 17 is an elevational view of a locking assembly for securing the frame to an underside of the tank.

As shown in FIGS. 1, 3 and 4 support system 10 may also include patient side rails generally 90 on one or both sides of tank 15 which may be raised or lowered, and which will be described in specific detail hereinafter. An overhead support frame generally 50 may also be included for receiving such medical apparatus as might be employed in treatment of a patient. Support frame 50 generally includes inverted U shaped members at opposite ends of tank 15, which include vertical legs 54 and one or more horizontal members 56 connecting same. At a lower end, vertical legs 54 turn inwardly, defining horizontal sections 55 that extend along an underside of tank 15 to a point adjacent pedestal 16 where they make a further turn of approximately 90 degrees in a direction toward the opposite leg portion 55 defining leg locking sections 55', (FIG. 17), and are received in a clamp 51 secured to bottom wall 13 of tank 15 as may be seen in FIG. 17. Clamp 51 includes a base 52 secured to bottom wall 13 that defines a V shaped section 52' therein and to which is hingedly secured a cover 53 that defines a matching V shaped section 53'. Connector bolts 57 or the like secure cover 53 to base 52 with V shaped sections 52' and 53' being sized to secure leg sections 55' therewithin. As such, frame 50 may be easily attached to or removed from tank 15 as desired. One or more horizontal support bars 58 may extend longitudinally along tank 15, being secured adjacent opposite ends to cross members 56. Spacer support arms 59 are also provided which are secured to side walls 11 of tank 15 and terminate in bifurcated sections 59' that are received about vertical legs 54.

One or more steps 25 may also be pivotally secured to pedestal 16 at pivot points 26 whereby steps 25 may be lowered as shown in FIG. 1 to facilitate more ready access to a patient, or raised as shown on the right side of FIG. 4 to reduce overall width of system 10 for movement. As seen in FIG. 4, sidewalls 16' of pedestal 16 taper inwardly, permitting steps 25 in the raised position to pivot in excess of 90 degrees and thus reduce the likelihood of a step falling to a down position during movement of the system. Further, when steps 25 are raised, as may be seen in FIG. 4, same reside totally within the maximum width D of tank 15 to ensure passage of system 10 through doorways, etc. In fact, as mentioned hereinbefore, and as can be viewed on FIG. 4, when side rails 90 are lowered and steps 25 raised, nothing on system 10 extends beyond the outer edges of tank 15.

Making specific references to FIGS. 5, 6, 7, 14, further details of one embodiment of the patient support system 10 of the present invention will now be described in detail. A perforated support plate 30 is located within the confines of side walls 11, generally following the inside oval shape of tank 15. Plate 30 resides above a plurality of spacer 40 which supports plate 30 above bottom tank wall 13, with the space therebetween defining a plenum chamber 35. As indicated specifically in FIG. 6, support element 30 is preferably a perforated plate that permits the passage of air therethrough and possesses adequate strength to support the remaining materials thereabove. A plurality of mounting holes 32 are spaced about the surface of plate 30 in predetermined arrangement along with a bead drain opening 33.

A diffuser board 36 is receivable atop perforated plate 30 and is secured with plate 30 to bottom wall 13 of tank 15 in a fashion to be described. Accordingly, diffuser board 36 is shaped similarly to plate 30 though slightly smaller and is provided with mounting openings 37 and a bead drain opening 38 located in predetermined arrangement thereacross. Making particular reference to FIG. 14, it can be seen that spacer means 40 are located between perforated plate 30 and bottom wall 13 of tank 15 to define plenum chamber 35. Mounting openings 14 are spaced about bottom wall 13, corresponding to openings 32 of plate 30 and openings 37 of diffuser board 36. In one embodiment, spacers 40 include a body portion 41 with reduced size plug sections 42 at opposite ends of same which cooperate to define shoulders 43 adjacent thereto. A threaded bore opening 44 extends at least partially through spacers 40, from opposite ends of same, and preferably entirely therethrough. Plug sections 42 are sized to be receivable in openings 14' of bottom wall 13 and openings 32 of perforated plate 30 with shoulders 43 abutting same. A lower bolt or connector 45 extends upwardly from beneath tank 15, though bottom wall openings 14' and is threadably received in threaded opening 44. While not shown, lower bolt 45 may be employed to secure other apparatus such as the support frame clamps 51 to the underside of tank 15. An upper bolt or connector 46 extends downwardly through openings 37 of diffuser board 36 and is threadably received in central opening 44 of spacers 40. In this fashion plate 30 and diffuser board 36 can be properly and securely mounted within tank 15.

Figure 14:
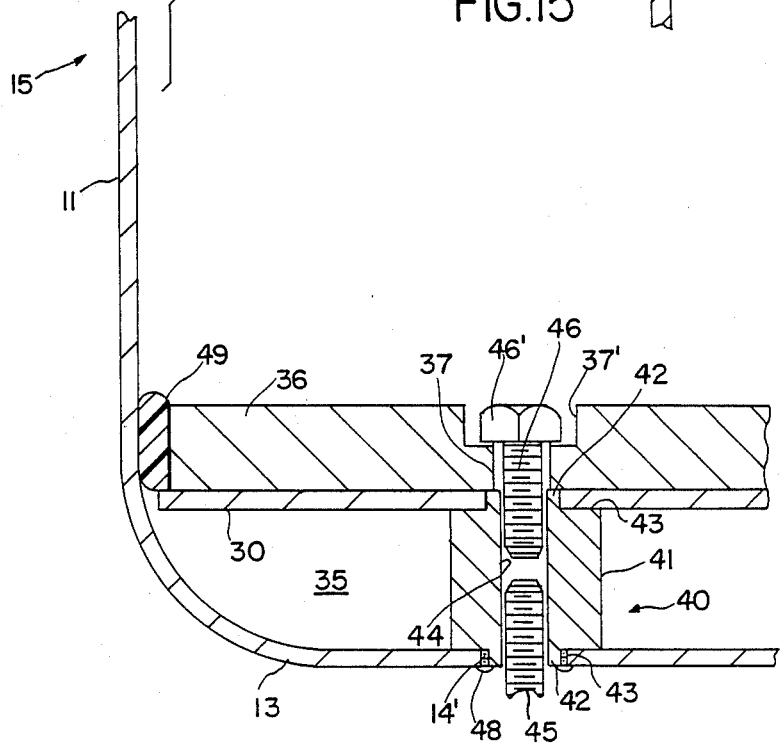
FIG. 14 is a partial vertical cross sectional view of a tank for a patient support system illustrating sheet attachment means and relationship of the preferred support porous plate and the diffuser board.

Also as shown in FIG. 14, a sealing means 48 is located at bottom wall openings 14', while a further sealing means 49 is received about the outer periphery of diffuser board 36 against an inside surface of side walls 11. Plenum chamber 35 is thus effectively sealed, forcing fluid to pass upwardly through diffuser board 36. While plate 30 and diffuser board 36 are illustrated as planar elements, it is within the purview of the present invention that contoured elements may be employed as described in commonly assigned U.S. Pat. No. 4,483,029 issued November 20, 1984. For example diffuser board 36 may vary according to the dictates of patient activity and weight, whereby in those areas where a greater weight per unit area is expected to occur, the contour of the diffuser element permits a greater depth of granular material thereabove. Conversely, in those areas peripheral to the support structure as well as areas where light patient contact will be experienced, a lesser depth of granular material may be provided above the diffuser plate. Such reduces the amount of granular material required, again further reducing the overall weight of system 10. Further diffuser board 36 which may be a pressed board of a particular porosity is preferably hydrophobic such that contamination by body fluids is lessened. A hydrophobic material such as the commonly available fluorocarbons may be sprayed onto the diffuser board 36 to impart hydrophobicity thereto.

Figure 16:
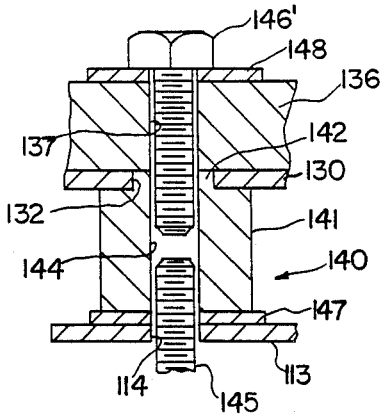
FIG. 16 is a partial vertical cross sectional view through the bottom wall, spacer means, support plate and diffuser board illustrating a further embodiment of same.

A further embodiment of the perforated plate in diffuser board arrangement is illustrated in FIG. 16. Spacers 140 are provided with a body portion 141 that has an end plug section 142 for receipt in mounting openings 132 of perforated plate 130 only. A resilient washer 147 slightly larger than spacer 140 is located adjacent bottom wall 113, and when bolt 145 is secured within openings 144 of spacer 140, washer 147 seals opening 114 in wall 113. Note also that the diffuser board opening 137 is not countersunk and a washer 148 is located between bolt head 146' and diffuser board 136.

A quantity of granular material 60, preferably ceramic beads or spheres, is received atop diffuser board 36, and beneath sheet 20. In an inactive, non-fluidized state the granular materials 60 are concentrated on board 36 and a patient residing thereon will mold itself within the mass. Generally the total quantity of granular material amounts to somewhere in a range of from about 1200 to about 1600 pounds. One can thus readily ascertain the continuous concern over weight of such a patient support system. Further, from time to time it becomes necessary to remove granular material 60 from tank 15, to resterilize same or replace same with new material. Drain openings 33 and 38 in plate 30 and diffuser board 36 respectively are provided for such removal. In normal use a plug (not shown) closes opening 38 in diffuser board 36 to prevent loss of granular material therethrough. A drain chute or the like 17 may be placed in communication with opening 33 of plate 30 for bead removal, and extend through bottom wall 13 (see FIG. 3) for bead removal. A cap 17' is threaded to chute 17 to close same when not in use.

Figure 5:
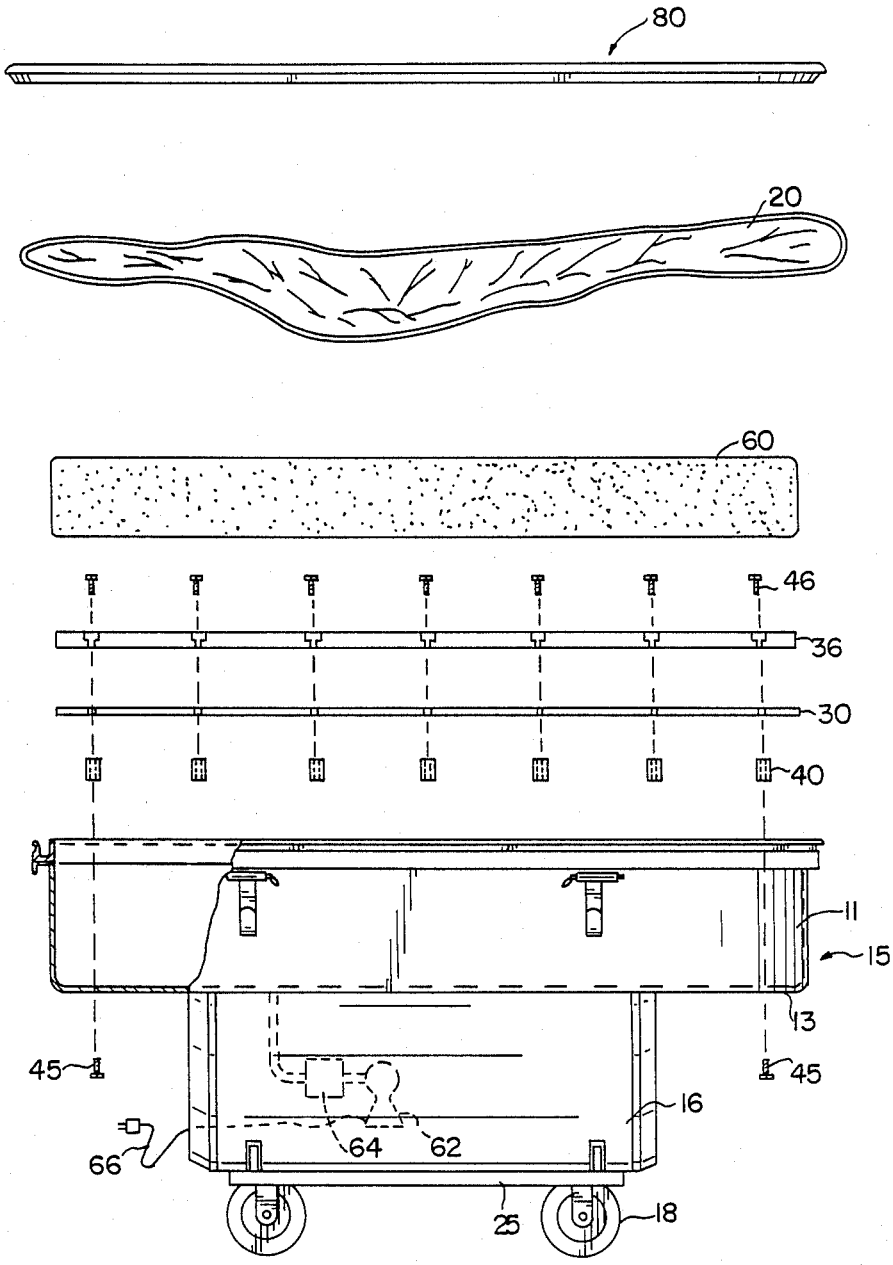
FIG. 5 is a side exploded view of components of the patient support system according to the present invention.
Figure 6:
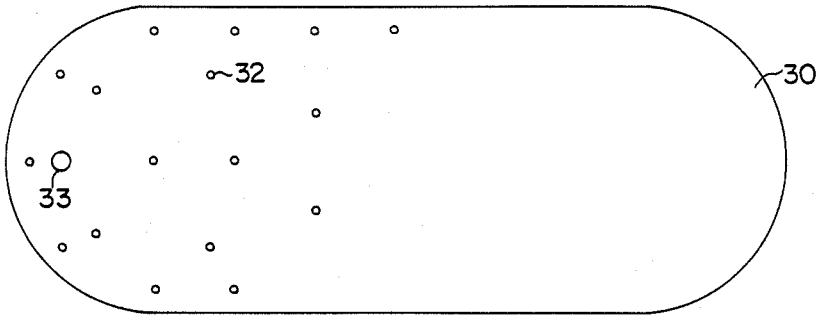
FIG. 6 is a partial plan view of a preferred support porous plate according to the present invention.
Figure 7:
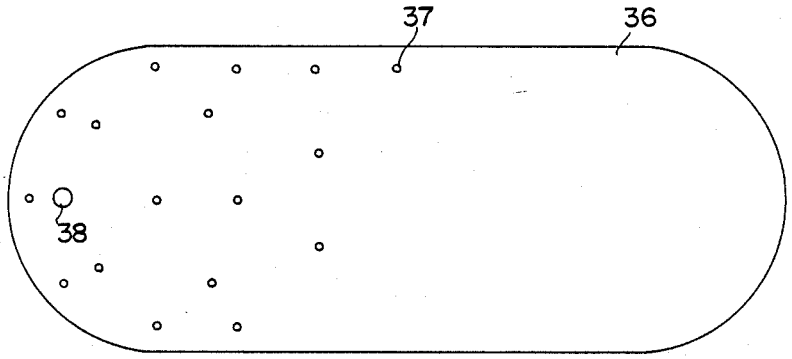
FIG. 7 is a partial plan view of a diffuser board according to the present invention.
Figure 8:
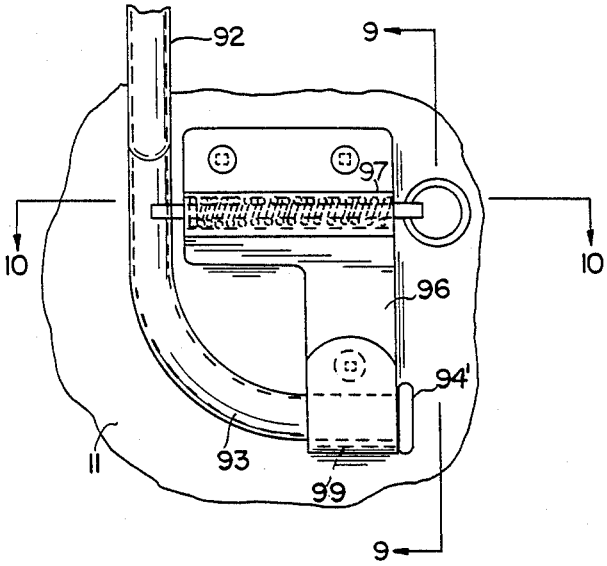
FIG. 8 is a partial side elevational view of the tank of a patient support system partially illustrating details of a side rail mounting and locking system.
Figure 9:
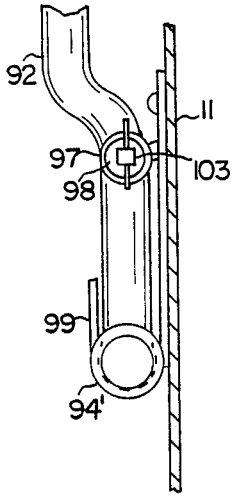
FIG. 9 is an end view of the side rail mounting and locking system of FIG. 8, taken along a line IX—IX.
Figure 10:
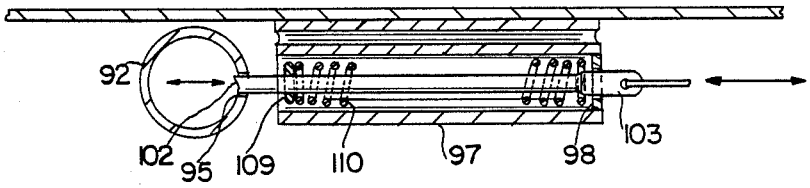
FIG. 10 is a horizontal cross sectional view of the side rail mounting and locking system as illustrated in FIG. 8, taken along a line X—X.
Figure 11:
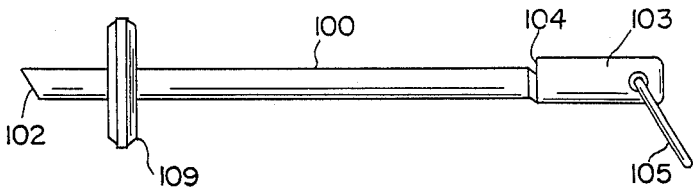
FIG. 11 is a side view of a locking pin for a side rail mounting and locking system according to the present invention.
Figure 12:
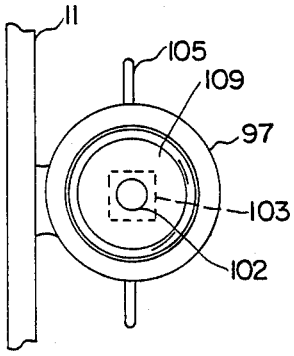
FIG. 12 is an end view of a locking cylinder for a side rail mounting and locking system according to the present invention when viewed from a left side as depicted in FIG. 8.
Figure 13:
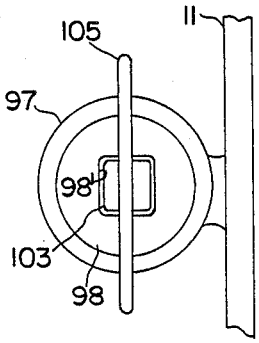
FIG. 13 is an opposite end view of the locking cylinder as illustrated in FIG. 12.

A fluid pressure generating means generally 62 is schematically illustrated in phantom in FIG. 5. Pressure generating means 62 is preferably located within pedestal 16 and is in communication with plenum chamber 35. As further indicated, a fluid conditioning means 64 may also be associated with pressure generating means 62 to heat, cool, and otherwise precondition the fluid entering plenum chamber 35. When fluid pressure generating means 62 is actuated, fluid pressure is produced within plenum chamber 35, adequate to pass through plate 30 and diffuser board 36 to fluidize granular material 60 sufficiently to support a patient hereon. Such patient support is provided without introducing any pressure points on the patient's body that could lead to the development of decubitus ulcers. In a non-fluidized state, the granular material assumes such rigidity that once the patient's body settles into same, the patient can be placed in traction against the granular material mass.

With pressure generating means 62 and fluid conditioning means 64 located within pedestal 16, it is only necessary to provide electrical connector means 66 to fluid pressure generating means 62 to electrically actuate same for generation of fluid pressure. In fact, fluid pressure generating means may be battery operated, whereby, a totally self-contained fluidized patient support system 10 would be provided. Insofar as fluid pressure generating means 62 is concerned, any suitable apparatus capable of generating adequate fluid pressure within plenum chamber 35 is acceptable. With a generally constant fluid pressure within plenum chamber 35, the fluid escapes plenum chamber 35 via diffuser plate 36, and acts on the granular material 60 to suspend material 60 above the diffuser board 36, at a particular level.

As mentioned above, it is likewise within the scope of the present invention to provide means for intermittent or cyclic actuation of fluid pressure generating means 62. Generally speaking, the system would then be capable of intermittently actuating fluid pressure generating means 62 at predetermined intervals to fluidize the granular material 60 and thus suspend the patient atop same. During deactuated intervals, the patient will settle within the granular material with the patient body defining a body contour therewithin. Such permits, as mentioned above, traction to be imparted to the patient against the rigidity of the granular material in the non-fluidized state and likewise permits pressure variation on the patient to lessen further the incidence of development of decubitus ulcers.

Granular materials suitable for use in the improved patient support structure of the present invention may be any suitable granular material that will become fluidized upon receipt of the desired fluid pressure. Such materials include, but are not limited to, sand, glass beads, ceramic spheres, and the like.

Sheet or covering 20 that is employed in conjunction with patient support system 10 should be porous in nature to permit the passage of air or other fluid therethrough while impervious to the passage of granular materials. In order to confine granular material 60 within tank 15, sheet 20 must be affixed about the periphery of same. Making particular reference to FIGS. 14 and 15, preferred sheet fixation means are illustrated. In FIG. 14, side wall 11 is illustrated having an outwardly turned lip 12 around an upper end of same. An upper rim generally 70 is secured to lip 12 by a bolt 71 or the like. Rim 70 is a bifurcated member having a base 72 and opposite upstanding legs 74 and 78. Outer leg 74 defines a detent 75 therealong with an outwardly projecting tip 76. Leg 74 further has a lower section 77 that extends downwardly below base 72. Inner leg 78 of rim 70 extends upwardly from base 72, terminating at outwardly projecting tip 79 which defines a shoulder 79' therebeneath.

A rim cover 80 is provided around an upper surface of tank 15, mating with rim 70 in snap fitting relationship. Rim cover 80 includes a body 81 having a smooth rounded outer surface 82 that defines the uppermost surface of tank 15. A central protrusion 83 extends from an underside of cover body 81 and is residable within the U shape section of rim 70 defined by legs 74, 78 and base 72, and includes a tapered tip 83' that resides beneath shoulder 79' of leg tip 70. Rim cover body 81 further includes an inner extension 84 that is residable about leg tip 79 and an outer extension 85 that is snap-fittingly receivable about outer leg tip 76 by protrusion 85' that resides within detent 75.

Rim cover 80 is preferably an extended polymeric rubber element of unitary construction, and as seen in FIG. 14, is employed in sections of desired length to finish the upper surface of tank side walls 11 while securing cover sheet 20 thereto. A rubber having a durometer of from about 60 to 70 is preferred whereby adequate flexibility is achieved while permitting a patient to be slid thereover. A lower durometer hardness hinders sliding of the patient across the cover. Particularly, sheet 20 is provided with a bead 21 around the periphery of same that is provided by an elongated element located within a hemmed edge of sheet 20. Bead 21 is preferably provided by an elasticized cord of a predetermined size with respect to the relative dimensions of cover 80 to rim 70 to be securely held therebetween. An edge of sheet 20 with bead 21 is thus placed within the U shaped section of rim 70, and rim cover 80 snap fitted thereover to removeably secure sheet 20 therewithin. As illustrated, the outer edge of sheet 20 with bead 21 is collected in the U shaped section against leg 78, being held thereby by central protrusion 83 of rim cover body 81. Note also that tapered tip 83' of central protrusion 83 traps a portion of sheet 20 beneath shoulder 79' of inner leg 78. A cavity 81' within rim cover body 81 affords adequate collapsibility to rim cover 80 to permit same to be installed over sheet 20. If desired, cavity 81 may be partially filled with a liquid or other material to improve the locking relationship of rim cover 80 to rim 70, and in fact can be closed and pressurized for improved holding power.

Figure 15:
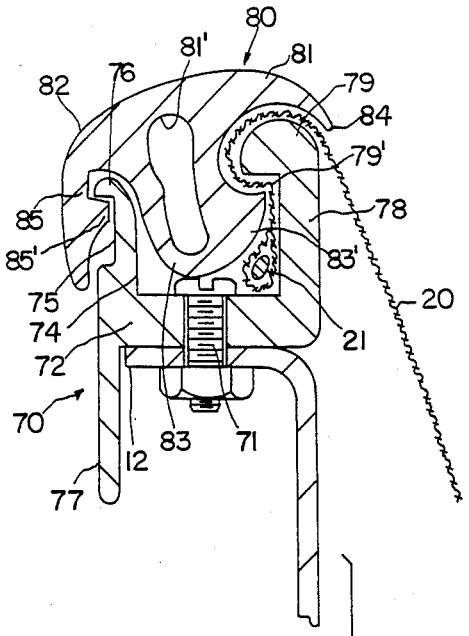
FIG. 15 is a partial vertical cross sectional view of a tank for a patient support system illustrating a further embodiment of a sheet retainer means.
Figure 15:
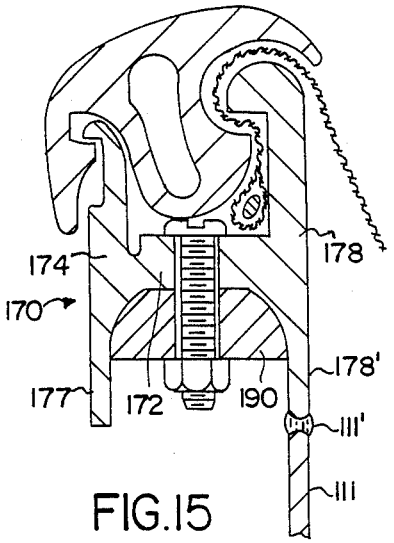

FIG. 15 illustrates a further embodiment of a patient support system in which side walls 111 do not include an outwardly turned lip. Instead a rim generally 170 is provided of like design as rim 70 of FIG. 14 with the exception that inner leg 178 includes a lower extension 178' that extends below base 172 in similar fashion to lower extension 177 of outer leg 174. Extension 178' is welded to side walls 111 at 111' and a further support member 190 is secured beneath rim 170.

Making reference to FIGS. 8 through 13, side rails generally 90 may be removably mounted to side walls 11 of tank 15 and when mounted are pivotably moveable from a down to an up position where the rails may be locked in place. Rails 90 include vertical legs 92 with horizontal members 94 served therebetween. Vertical legs 92 are bent along the length of same to extend around rim 70 and cover 80 in the raised position and to reside within the maximum width D of tank 15 when in the lowered position (see FIG. 4). Vertical legs 92 further have an inturned pivot leg section 93 at a lower end with an enlarged terminal end 94 and further define a lock pin receiving opening 95 therealong. A mounting bracket 96 is secured to side wall 11 internally of each vertical leg 92 and includes a tubular lock channel 97 and a U shaped lower end 99 that receives a pivot leg 93 therein. Tubular channel 97 is generally cylindrical in shape with a plate 98 located at inner end of same which defines a non-circular opening 98' therethrough. A locking pin 100 is receivable in lock channel 97 with a coil spring 110 received therearound adjacent shoulder 109. A forward end of locking pin 100 has a beveled surface 102 thereat while a rear end 103 of pin 100 has a non-circular cross section, that generally matches the shape of opening 98' of end plate 98 with a notched area 104 at an end of same. A ring 105 or the like may be received at the inner end 103 to facilitate manual manipulation of pins 100, and to hold same in channel 97.

With side rails 90 freely received in U-shaped ends 99 of mounting bracket 96, enlarged pivot leg ends 94 preclude lateral disengagement of rail 90 from mounting bracket 96. Upward pivotal movement of rail 90 about bracket 96 will bring vertical legs 92 into contact with the beveled surface 102 of the locking pins 100, forcing pins 100 inwardly of channels 97 against the bias of springs 110 until pins 100 meet with lock pin openings 95 at which point pins 100 move within openings 95 to lock rail 90 in the raised position. To lower rail 90, pins 100 are pulled inwardly out of locking openings 95. With forward ends 102 out of openings 95 and non-circular sections 103 of pins 100 outside of channels 97, a slight rotation of pins 100 will misalign same with end plate opening 98' thus securing pins 100 in an inactive position. Rail 90 can then be lowered at will. Alternatively, notch 104 can be brought into contact with end plate 98 to hold pin 100 out of lock pin receiving opening 95 without rotation.

Having described the present invention in detail, it is obvious that one skilled in the art will be able to make variations and modifications thereto without departing from the scope of the invention. Accordingly, the scope of the present invention should be determined only by the claim appended hereto.

That which is claimed is:

1. An improved mobile patient support system, comprising:

(a) a generally oval shaped tank having a bottom wall, side walls, and an open top, said side walls having a contoured upper rim that extends laterally outward therefrom to a maximum dimension that is less than the width of a passageway through which said system is designed to be used;

(b) a wheeled support housing received beneath said tank and being secured thereto;

(c) fluid diffuser means received within said tank and spaced above said bottom wall;

(d) a plenum chamber defined beneath and in fluid communication with said fluid diffuser means;

(e) a mass of granular material received within said tank atop of said fluid diffuser means;

(f) fluid pressure generating means in communication with said plenum chamber, said fluid pressure generating means being actuatable for generating fluid pressure within said plenum chamber adequate to diffuse through said fluid diffuser means and fluidize said granular material atop of said fluid diffuser means sufficient to support a patient thereon;

(g) a flexible sheet removably secured about said upper rim of said tank, said flexible sheet being porous to the passage of fluid and impervious to the passage of said granular material; and (h) a resilient rim cover nondestructively removable and securable by hand unaided by any tool about said upper rim of said tank for securing said flexible sheet, said resilient rim cover having a generally smooth upper surface; said resilient rim cover having a lower surface contoured for snap fitting engagement with said contoured upper rim and for receiving said flexible sheet between said contoured upper rim and said rim cover without extending through said sheet; said rim cover cooperating with said upper rim to retain said flexible sheet therebetween with adequate force to prevent the weight of the patient from pulling said flexible sheet from between said contoured upper rim and said resilient rim cover when said granular material is in a fluidized or a non-fluidized state.

2. An improved mobile patient support system as in claim 1, wherein:

(a) said resilient rim cover being formed of a rubber having a durometer of from about 60 to 70 to provide adequate flexibility while permitting the patient to be slid thereover.

3. An improved mobile patient support system, comprising:

(a) a generally oval shaped tank having a bottom wall, side walls, and an open top, said side walls having a contoured upper rim that extends laterally outward therefrom to a maximum dimension that is less than the width of a passageway through which said system is designed to be used;

(b) a wheeled support housing received beneath said tank and being secured thereto;

(c) fluid diffuser plate means received within said tank and located above said bottom wall, said fluid diffuser plate means and said tank walls defining a plenum chamber therebetween;

(d) a mass of granular material received within said tank atop of said fluid diffuser plate means;

(e) fluid pressure generating means located within said housing and being in communication with said plenum chamber, said fluid pressure generating means being actuatable for generating fluid pressure within said plenum chamber adequate to diffuse through said fluid diffuser plate means and fluidize said granular material atop of said fluid diffuser plate means sufficient to support a patient thereon;

(f) fluid conditioning means associated with said fluid pressure generating means for conditioning fluid prior to entry of same into said plenum chamber;

(g) a flexible sheet removably secured about said upper rim of said tank, said flexible sheet being porous to the passage of fluid and impervious to the passage of granular material;

(h) a resilient rim cover nondestructively removable and securable by hand unaided by any tool about said upper rim of said tank for securing said flexible sheet, said resilient rim cover having a generally smooth upper surface; said resilient rim cover having a lower surface contoured for snap fitting engagement with said contoured upper rim and for receiving said flexible sheet between said contoured upper rim and said lower contoured surface of said rim cover without extending through said sheet; said rim cover cooperating with said upper rim to retain said flexible sheet therebetween with adequate force to prevent the weight of the patient from pulling said flexible sheet from between said contoured rim and said rim cover when said granular material is in a fluidized or a non-fluidized state; and (i) at least one side rail assembly pivotally secure to at least one of said tank side walls and being movable between a raised position above said upper rim of said tank, for restricting patient movement from said tank, and a lowered position for allowing improved access to a patient in said tank, whereby during movement of said improved mobile patient support system, no appurtenance thereto extends laterally beyond the maximum width dimension of a passageway through which said system is designed to be used, thereby fostering maneuverability and mobility of said improved mobile patient support system.

4. An improved mobile patient support system, comprising:

(a) a generally oval shaped tank having a bottom wall, side walls, and an open top, said side walls having a contoured upper rim that extends laterally outward therefrom to a maximum dimension that is less than the width of a passageway through which said system is designed to be used;

(b) a wheeled support housing received beneath said tank and being secured thereto;

(c) fluid diffuser plate means received within said tank and spaced above said bottom wall, whereby a plenum chamber is defined between said fluid diffuser plate means and said bottom wall;

(d) support means provided beneath said fluid diffuser means for supporting said fluid diffuser plate means above said bottom wall of said tank;

(e) a mass of granular material received within said sheet; said rim cover cooperating with said upper rim to retain said flexible sheet therebetween with adequate force to prevent the weight of the patient from pulling said flexible sheet from between said contoured rim and said rim cover when said granular material is a fluidized or a non-fluidized state; and (k) at least one side rail assembly pivotally secured to at least one of said tank side walls and being movable between a raised position above said upper rim of said tank, for restricting patient movement from said tank, and a lowered position substantially below said upper rim, for allowing improved access to a patient in said tank, whereby during movement of said improved mobile patient support system, no appurtenance thereto extends laterally beyond the maximum width dimension of a passageway through which said system is designed to be used, thereby fostering maneuverability and mobility of said improved mobile patient support system.

* * * * *